US005307956A

United States Patent [19]

Richter et al.

[11] Patent Number: 5,307,956

[45] **Date of Patent: * May 3, 1994**

[54] FIVE GALLON NESTABLE PLASTIC SYRUP CONTAINER

[75] Inventors: Simon J. Richter, Marietta, Ga.; Frank G. Hohmann, Tenafly, N.J.

[73] Assignee: The Coca-Cola Company, Atlanta, Ga.

[21] Appl. No.: 789,271

[22] Filed: Nov. 8, 1991

[ * ] Notice: The portion of the term of this patent subsequent to Nov. 12, 2008, has been disclaimed.

Related U.S. Application Data

[63] Continuation-in-part of Ser. No. 429,553, Oct. 31, 1989, Pat. No. 5,064,101.

[51] Int. Cl.[5] ..... B67D 5/60

[52] U.S. Cl. ..... 222/143; 222/464; 222/501; 206/510; 215/10; 141/351

[58] Field of Search ..... 222/501, 465.1, 478, 222/541, 464, 143, 1; 141/351-354; 215/10, 315; 251/339, 336, 343; 206/509, 510, 512; 220/669, 675, 674

[56] References Cited

U.S. PATENT DOCUMENTS

| | | | |
|---|---|---|---|
| 81,143 | 8/1868 | Cook | 220/674 |
| 152,168 | 6/1874 | Renwick | 220/674 |
| 456,934 | 8/1891 | Bartley et al. . | |
| 2,051,736 | 6/1935 | Misfeldt . | |
| 2,114,137 | 4/1938 | Conner | 220/674 X |
| 2,536,400 | 1/1951 | Thompson . | |
| 3,176,879 | 4/1965 | Mojonnier . | |
| 3,224,621 | 12/1965 | Upthegrove | 220/669 X |
| 3,323,681 | 6/1967 | Di Vette et al. . | |
| 3,369,688 | 8/1966 | Dike . | |
| 3,448,775 | 6/1969 | Limbach et al. | 220/669 X |
| 3,547,299 | 12/1970 | Kepple | 220/674 X |
| 3,563,408 | 2/1971 | Bijvoet | 220/674 X |
| 3,942,688 | 3/1976 | Pryor et al. . | |
| 4,113,129 | 9/1978 | Cambio, Jr. . | |
| 4,371,015 | 2/1983 | Simons . | |
| 4,606,476 | 8/1986 | Pocock et al. . | |
| 4,640,466 | 2/1987 | Walker . | |
| 4,805,793 | 2/1989 | Brandt et al. . | |
| 4,832,200 | 5/1989 | Deaton et al. . | |
| 4,892,125 | 1/1990 | Rudick et al. . | |
| 4,913,316 | 4/1990 | Richter . | |
| 4,972,972 | 11/1990 | Goguen | 222/465.1 X |
| 5,064,101 | 11/1991 | Richter et al. | 222/143 |
| 5,092,474 | 3/1992 | Leigner | 220/675 X |
| 5,110,013 | 5/1992 | Clark et al. | 222/464 X |

FOREIGN PATENT DOCUMENTS

| | | | |
|---|---|---|---|
| 2021185 | 11/1979 | United Kingdom | 220/674 |
| 2237550 | 5/1991 | United Kingdom | 220/669 |

*Primary Examiner*—Andres Kashnikow
*Assistant Examiner*—Kenneth DeRosa
*Attorney, Agent, or Firm*—Birch, Stewart, Kolasch & Birch

[57] ABSTRACT

A disposable and recyclable plastic container for use in a post-mix beverage dispensing system includes first and second openings at a top end thereof. The container may be filled with syrup through the first opening and withdrawn by a pump through the second opening. The second opening is defined by an upper end of a tube, which is integrally formed with the container by blow-molding. The tube extends from the top end of the container, down the exterior of the container sidewall and through the bottom. As syrup is withdrawn, the first opening, or an associated vent, vents the container to assist in the withdrawal of syrup. The second opening and tube have a valve actuator therein for a spring-loaded valve in a conventional quick-disconnect coupling such as used in bag-in-box type systems. The top and bottom of the container have complementary shapes to permit vertical nesting and stacking of plural like containers, and sidewalls of the container are concave to prevent bulging of the sidewalls when containers are filled.

16 Claims, 4 Drawing Sheets

FIVE GALLON NESTABLE PLASTIC SYRUP CONTAINER

This application is a continuation-in-part of application Ser. No. 07/429,553 filed on Oct. 31, 1989, now U.S. Pat. No. 5,064,101. The entire contents of which are hereby incorporated by reference.

BACKGROUND OF THE INVENTION

The present invention relates to a plastic container for syrup or flavor concentrate suitable for use with a post-mix beverage dispenser. More specifically, the present invention relates to a disposable and recyclable container for syrup or flavor concentrate, said container being connectable to a syrup pump which withdraws the syrup or flavor concentrate from the container and supplies it to a mixing station in the post-mix dispenser.

Post-mix beverage dispensers, such as those used in fast-food restaurants or the like, generally store the syrup in either a stainless steel, pressurized container with a five-gallon capacity, or a bag-in-box type of container. The stainless steel type of container is known as a "Figal", an accepted abbreviation in the beverage dispensing art for a syrup container with a five-gallon capacity fabricated primarily of stainless steel. "Figal" containers are generally described in U.S. Pat. No. 3,186,577 to Tennison. The Figal container is advantageous in that the syrup therein is pressurized at the point of sale, eliminating the need for a pump to withdraw syrup therefrom. However, a "Figal" container has a disadvantage of being very expensive to manufacture, so it must be returned to the factory, sanitized and reused.

In contrast, bag-in-box packages for syrup are disposable and less expensive. However, bag-in-box type packages are not easily recyclable, so an associated waste disposal problem results. A typical bag-in-box type package is disclosed in U.S. Pat. No. 4,286,636 to Credle.

Bag-in-box packages of the general type disclosed in the Credle '636 patent are in wide use today in beverage dispensing systems which include air-operated reciprocating pumps coupled between the bag-in-box package and a dispenser nozzle by a quick-disconnect coupling. An example of such a quick-disconnect coupling is also illustrated in the Credle '636 patent.

Accordingly, a need in the art exists for a disposable, inexpensive syrup container for use with a postmix beverage dispenser, which is also recyclable.

SUMMARY OF THE INVENTION

Accordingly, it is a primary object of the present invention to provide a disposable and recyclable plastic syrup container in lieu of a conventional bag-in-box type of container.

It is another object of the present invention to provide a disposable and recyclable syrup container which can be connected to similar equipment used with bag-in-box type containers, such as a syrup pump by conventional quick-disconnect couplings.

The objects of the present invention are fulfilled by providing a disposable container for storing and dispensing liquid concentrate comprising:

a top end defining a first opening through which said container may be filled and a second opening through which concentrate may be withdrawn;

vent means associated with said first opening for controlling the flow of air into the container as concentrate is withdrawn from said second opening;

a base end for supporting said container in an upright position;

sidewalls connecting said base end to said top end, said sidewalls being concave toward an interior of said container;

a reinforcing pattern formed in said sidewalls for further precluding distortion of said sidewalls;

a conduit integrally formed with and extending along said sidewalls outboard of said container from the top end to the bottom end, said conduit joining said second opening at said top end of said container, said conduit being in liquid communication with the inside of said container at the bottom end thereof; and valve actuator means within said second opening for use in operating a valve in a coupling connectable to said second opening;

wherein said top end has a first characteristic shape and said bottom end has a second characteristic shape such that a bottom end of one container is nestable within the top end of another container for vertical stacking and storage of a plurality of containers, said second characteristic shape including opposing base sections alternated with opposing recessed areas, and a channel connecting the opposing base sections to facilitate complete drainage of concentrate from the container when the container is in an upright orientation, and wherein said concave sidewalls are outwardly expandable.

The coupling connectable to the second opening may be a conventional quick-disconnect coupling on the end of a flexible hose. This coupling includes a spring-loaded valve poppet which is pushed by the valve actuator means within the second opening of the container of the present invention.

The hose leading from the quick-disconnect coupling runs to the input side of a reciprocating pump which has the output side thereof coupled to the dispenser valves of the post-mix dispenser.

BRIEF DESCRIPTION OF THE DRAWINGS

The objects of the present invention and the attendant advantages thereof will become more readily apparent by reference to the drawings wherein like numerals refer to like parts and wherein.

DESCRIPTION OF PREFERRED EMBODIMENTS

Figure 1:
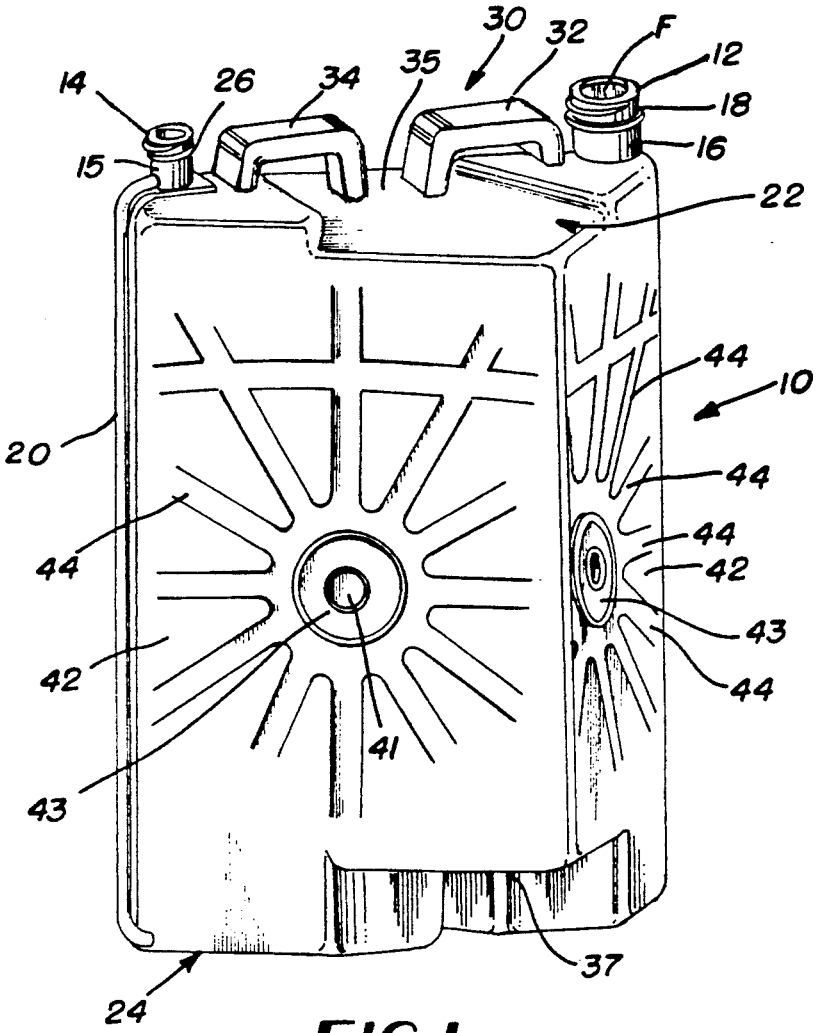
FIG. 1 is a top front perspective view illustrating a preferred embodiment of the syrup container of the present invention.

Referring to FIG. 1, there is illustrated a syrup container 10 of the present invention including a first opening 12 and a second opening 14. Opening 12 is larger than opening 14 and is defined by a protruding cylindrical neck 16 on a top end 22 of the container 10, which has an appropriate finish or threads 18 thereon for receiving a protective cap (not shown). Opening 12 also is preferably sealed by a foil F which is frangible to form an appropriate vent opening for reasons to be described hereinafter.

The smaller opening 14 is defined by a protruding cylindrical neck 15. The top end of cylindrical neck 15 is also provided with appropriate threads 26 or finish to receive a protective screw cap (not shown) which covers opening 14 during storage and transportation.

A conduit 20 is provided exterior to the container 10 extending from a base of cylindrical neck 15 at the top of the container to the base 24 of the container. Conduit 20 passes through the bottom end 24 of the container 10 into fluid communication with the interior of the container and is joined to the cylindrical neck 15 so that syrup within the container may be withdrawn through conduit 20 and opening 14 once the associated cap is removed, and opening 14 is fluidly coupled to an appropriate syrup pump, to be described hereinafter.

The larger opening 12 in the top end 22 of the container 10 is initially provided for filling the container with syrup or flavor concentrate, but during dispensing of syrup through conduit 20, opening 12 or an opening formed in the frangible foil F functions as a vent means for the container.

Figure 2:
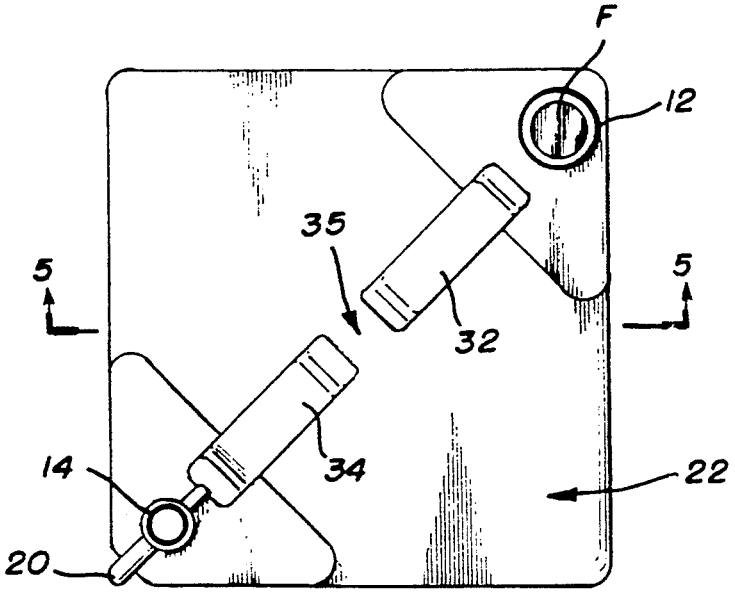
FIG. 2 is a top perspective view of the container shown in FIG. 1.
Figure 3:
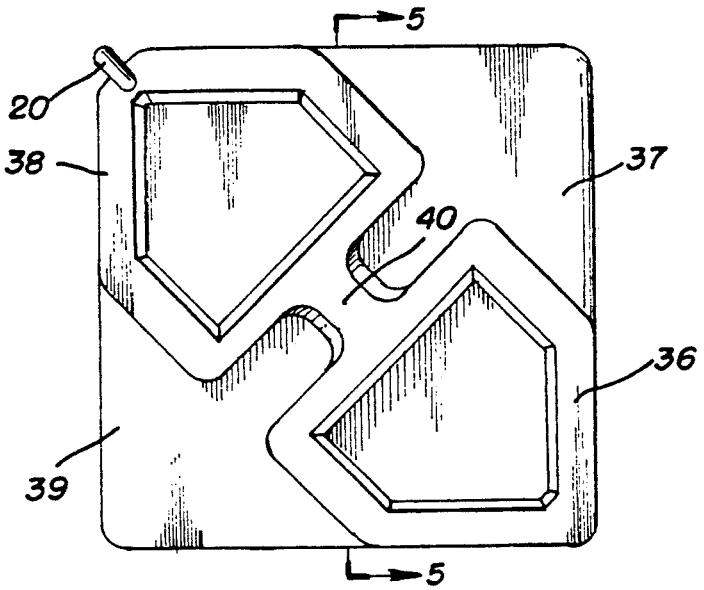
FIG. 3 is a bottom perspective view of the container shown in FIG. 1.

As further shown in FIGS. 2 and 3, the top end 22 of the container 10 is also provided with a two-part handle 30 including a first section 32 adjacent opening 12 and a second section 34 adjacent opening 14. The handle sections 32, 34 are spaced apart defining an interlock area 35 therebetween for receiving a complementary-shaped channel portion 40 of the bottom end 24 of a container of like kind, which may be stacked thereon.

The channel 40 is most clearly seen in FIG. 3 as joining opposing base sections 36 and 38. The remaining portion of the base includes elevated or recessed areas 37 and 39 which alternate with the base sections 36 and 38. When a container in an upright position is being drained, fluid from above the recessed areas 37, 39 will drain into the base sections 36, 38. Due to the fact that the discharge conduit 20 is only adjacent one base section 38 of the container, fluid from the opposing base section 36 must be able to flow to the base section 38 without tipping of the container 10. This drainage between base sections occurs via channel 40.

Figure 4:
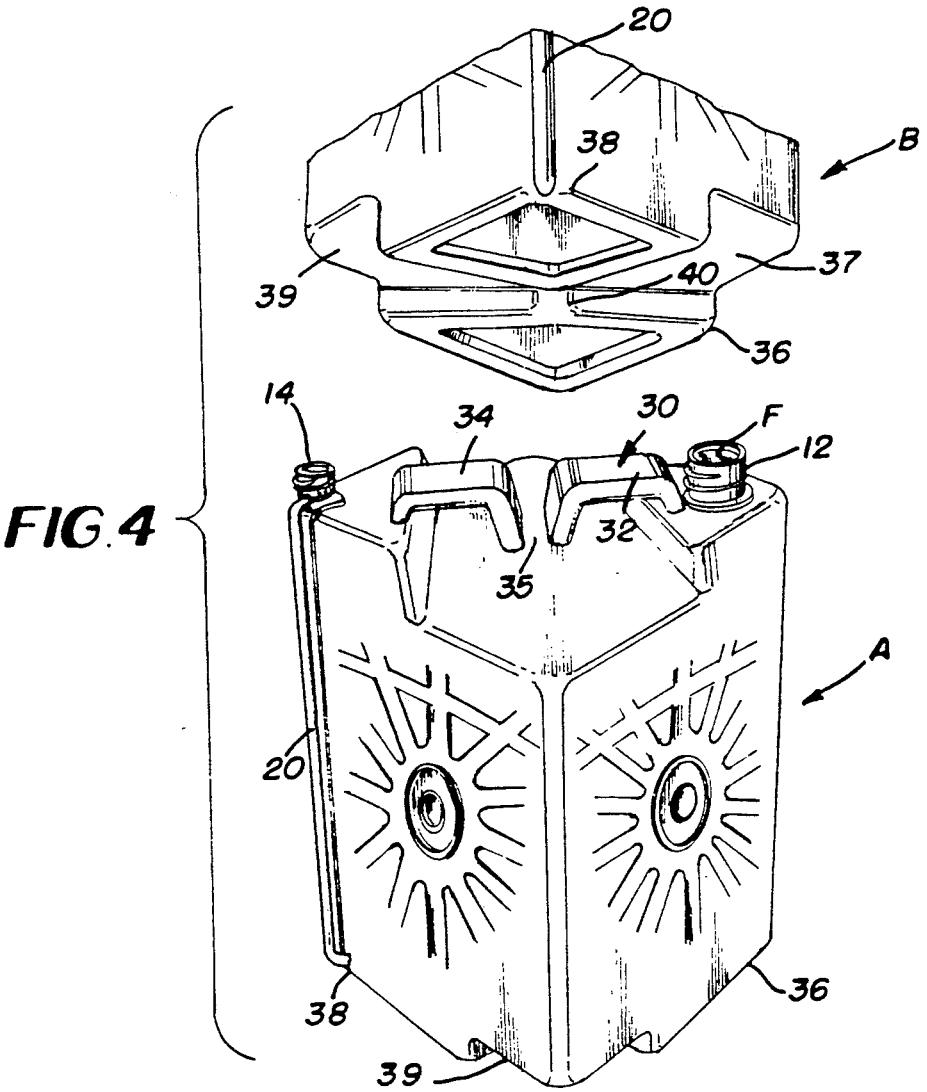
FIG. 4 is a view illustrating how the bottom end of a container B of the same type as a container A, when rotated 90 degrees, can be stacked on top of container A in a nested, interlocked relationship.

The manner in which two of the containers of the present invention may be stacked one upon the other and interlocked is illustrated in FIG. 4. It can be seen that the container A of FIG. 4 (the bottom container in FIG. 4) is displaced 90 degrees from the top container B which is to be stacked thereon. It can also be seen that the top of container A and the bottom of container B (like containers) have complementary shapes in order to facilitate vertical stacking and nesting, or interlocking, of the respective container ends. In particular, recessed areas 37, 39 on the bottom 24 of container 10 are of a predetermined height from the base of the container bottom sections 36 and 38 to receive protrusions including opening 12, first handle section 32 and opening 14, second handle section 34, respectively. Of course, the container may be stacked in either direction so long as channel 40 interlocks with interlock area 35.

Another feature illustrated in the figures is that the sidewalls 42 of the container on four sides thereof are concave with a reinforcing pattern such as radial ribs 44 to provide sidewall strength for the relatively thin, polyethylene sidewalls, as well as panels (not shown) which may be used for labelling with trademarks and/or logo. A central point of the concavity is at a central point 41 of button or donut shaped hub 43, which hub is preferably positioned approximately two-thirds of the distance down from the planar top surface 22 of the container 10 to the recessed area 37, 39 above the base of the container. The concavity of each of the sidewalls 42 enables the sidewalls to "give" in an outward direction when a container is filled, but does not permit the sidewalls to snap over the centerline or surface coplanar with the outer corner dimensions of the container.

More specifically, it should be understood that an internal pressure of a filled container increases as the distance down from the top of the container increases. This internal pressure is directed against the interior sidewalls of a container and the pressure exerted thereon Will also increase as the distance down the sidewall of the container increases. If rigidity or strength is lacking in the sidewall, internal pressure could cause the container sidewall to rupture outward. This problem is compounded when filled containers are stacked one on top of another for prolonged storage or transportation. The addition of a filled container stacked on a base container substantially increases the internal pressure which will be directed at interior sidewalls in the lower half of the base container.

In order to prevent rupturing of sidewalls of the container, the inventor has determined that the sidewall strength of the container will be substantially enhanced if the sidewalls are initially formed to be concave, with a central point of the concavity positioned at least one-half the distance down from the top 22 stacking surface to the recessed portion 37 above the base 24 of the container, and preferably two-thirds of the distance down from the top stacking surface of the container. When the container is filled, the internal pressure of the liquid will tend to push the panels outward thereby placing the panels under stress and rendering the container sidewalls more rigid. As previously mentioned, the sidewall panels do not flex or bulge beyond a predetermined point of the outer corner dimensions of the container.

The strength of the sidewalls are further improved by the combination of a reinforcing pattern such as the hub 43 with radial recessed ribs or spokes 44 extending in a starburst pattern outward from the hub. An additional horizontal rib near the top of the container may also be provided. The size of the hub and number of radial ribs should be designed to render sufficient strength to the concave sidewalls but still allow for ease of manufacture. Any appropriate reinforcing pattern may be utilized other than the hub and radial ribs shown, as long as the pattern strengthens the container sidewalls. For example, a total of twelve radial ribs in combination with the hub is shown in the drawings. Of primary importance, regardless of the number of radial ribs utilized, is the concave nature of the sidewalls. Once containers are filled and stacked, the inside pressure of the liquid will actually counteract the pressure from the stacked container which, absent the described container configuration, would otherwise cause the sidewalls to flex outward beyond a plane defined by the corner walls of the container.

Figure 5:
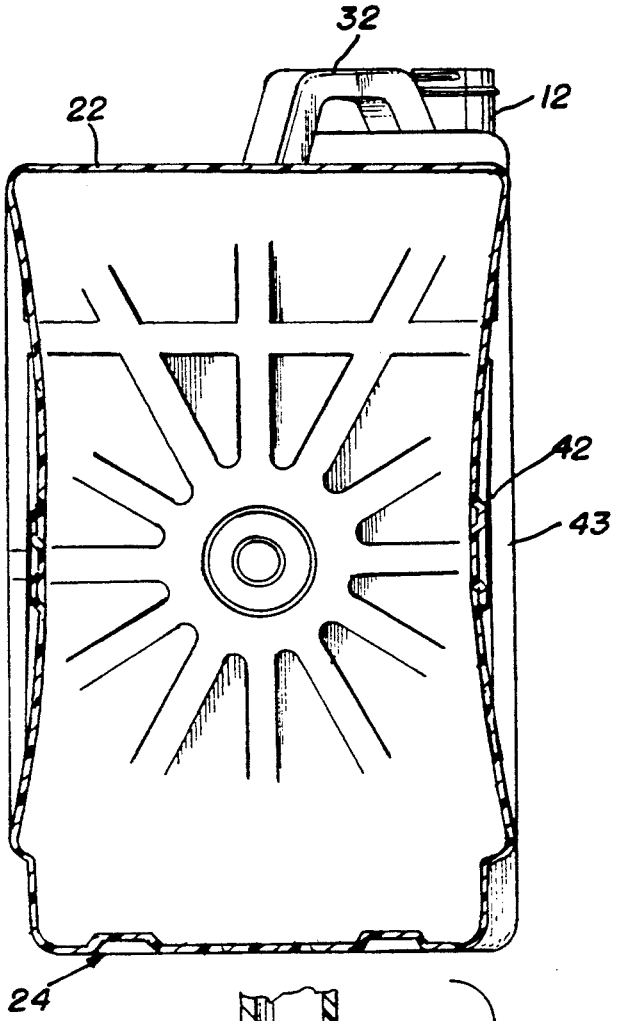
FIG. 5 is a cross-sectional view taken along lines 5—5 of FIG. 2 and FIG. 3.

FIG. 5 is a cross-sectional view taken along lines 5—5 of FIG. 2 and FIG. 3 and more clearly shows the concave nature of the container sidewalls 42.

The entire container 10 of FIG. 1 is preferably blow molded from a plastic material such as polyethylene in such a manner that conduit 20 is integrally formed with the rest of the container.

Figure 6:
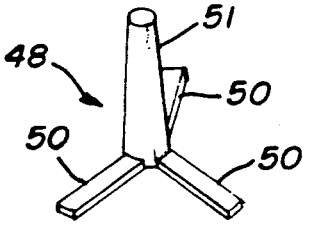
FIG. 6 is an enlarged view of a valve actuator secured within the smaller of the two openings in the top end of the container of FIG. 1.

As illustrated in FIG. 6, a plastic valve actuator, or insert, 48 is provided having three legs 50 defining a spider, and a vertical prong 51 which is secured within conduit 20 just below the opening 14. The legs 50 sit on the bottom of the opening or may optionally be snap-fit to the inner walls of conduit 20.

Figure 7:
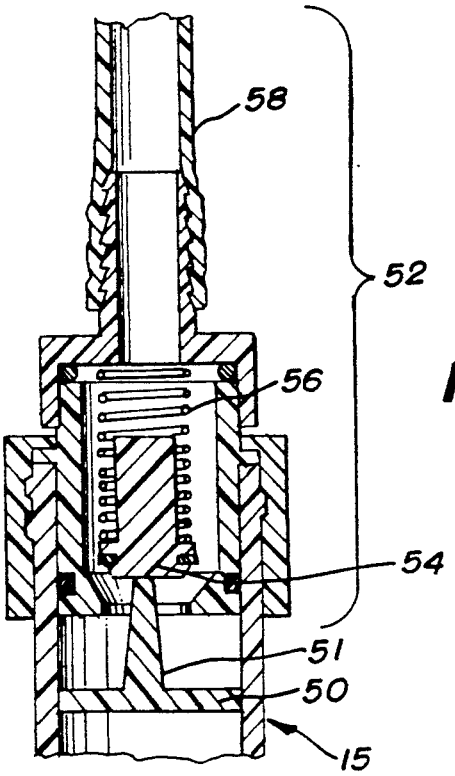
FIG. 7 is a cross-sectional view illustrating how a quick-disconnect coupling and associated flexible conduit can be coupled to the smaller of the two openings in the top end of the syrup container of FIG. 1.

Referring to FIG. 7, there is illustrated a conventional quick-disconnect coupling 52 including a spring-loaded poppet 54 which is a normally closed valve by virtue of the coil spring 56. As illustrated in FIG. 7, when coupling 52 is screwed onto the finish of neck 15, vertical prong 51 within opening 14 pushes up against poppet 54 to open the valve, permitting the flow of liquid from neck 15 to flexible tube 58.

Figure 8:
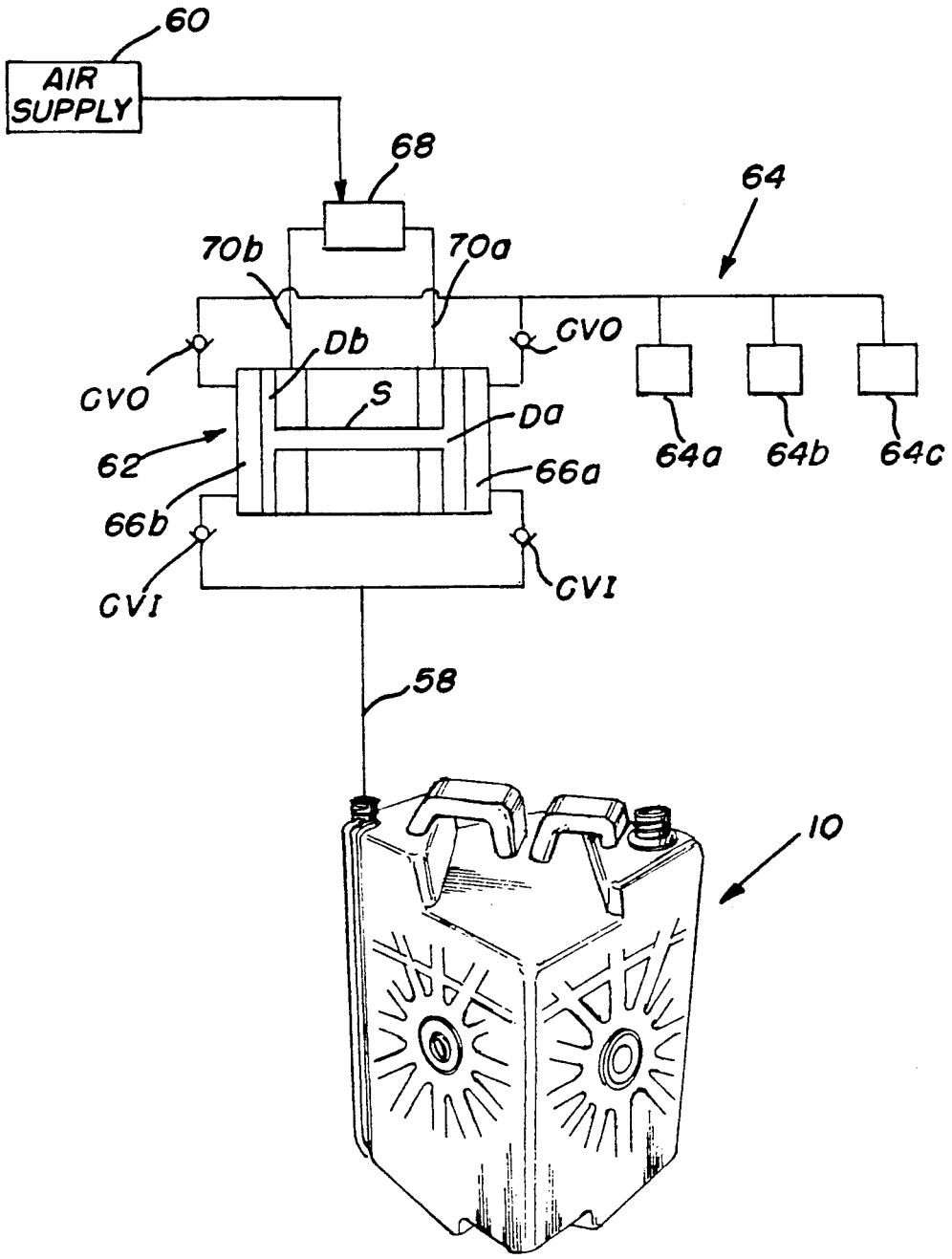
FIG. 8 is a schematic diagram of a post-mix beverage dispenser system including a double-acting reciprocating pump in combination with the syrup container of FIG. 1.

As illustrated in the dispensing system of FIG. 8, flexible tube 58 leads from container 10 to a double-acting pump 62, and is output from the pump to a set of dispenser nozzles 64, (64*a*, 64*b*, 64*n*). The pump 62 may be a pneumatically-powered, reciprocating diaphragm pump such as disclosed in U.S. Pat. No. 3,741,689, 4,123,204, or 4,172,689. Such a pump typically includes a reciprocating shaft S connected between a pair of diaphragms Da, Db, and pump chambers 66*a*, 66*b*, respectively. Gas from supply member 60 to drive the pump is alternately supplied to the inboard sides of diaphragms Da, Db by reversing valve 68 via lines 70*a*, 70*b*. As the pump reciprocates, liquid in chambers 66*a*, 66*b* on the outboard sides of diaphragms Da, Db is alternately discharged through outlet check valves CVO. Reversing valves suitable for use as valve 68 are also disclosed in the aforementioned pump patents.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A disposable container for storing and dispensing liquid concentrate comprising:

a top end defining a first opening through which said container may be filled, a second opening through which concentrate may be withdrawn and a planar stacking surface;

vent means associated with said first opening for controlling the flow of air into the container as concentrate is withdrawn from said second opening;

a base end for supporting said container in an upright position;

sidewalls connecting said base end to said top end, said sidewalls being concave toward an interior of said container;

a reinforcing pattern formed in said sidewalls for further precluding distortion of said sidewalls;

a conduit extending along said sidewalls outboard of said container from the top end to the base end, said conduit joining said second opening at said top end of said container, said conduit being in liquid communication with the inside of said container at the base end thereof; and valve actuator means within said second opening for use in operating a valve in a coupling connectable to said second opening;

wherein said base end of one container is nestable within the top end of another container for vertical stacking and storage of a plurality of containers, said base end including opposing base sections alternated with opposing recessed areas, and a channel connecting the opposing base sections to facilitate complete drainage of concentrate from the container when the container is in an upright orientation, and wherein said concave sidewalls are outwardly expandable when a container is filled with concentrate.

2. The container of claim 1, wherein said top end has a handle thereon, said handle having first and second gripping portions spaced apart for receiving the channel of the base end therebetween in a direction perpendicular to the gripping portions of said handle, said channel resting flat on the planar stacking surface of the top end of the container.

3. The container of claim 1, wherein said reinforcing pattern includes a hub portion having a center point at a distance from about one-half to about two-thirds of the distance down from the planar stacking surface of the container and a plurality of recessed ribs radially extending from the hub.

4. The container of claim 1, wherein said reinforcing pattern includes a hub portion having a concentric center at a position two-thirds of the distance down from the planar stacking surface of the container and a plurality of recessed ribs radially extending from the hub.

5. The container of claim 1, wherein said vent means includes a frangible foil secured over said first opening.

6. The container of claim 1, wherein said first opening is formed in an upstanding cylindrical neck portion of said top end, said neck portion having a threaded external finish.

7. A system for supplying liquid concentrate to a post-mix beverage dispenser comprising:

a top end defining a first opening through which said container may be filled, a second opening through which concentrate may be withdrawn and a planar stacking surface;

vent means associated with said first opening for controlling the flow of air into the container as concentrate is withdrawn from said second opening;

a base end for supporting said container in an upright position;

sidewalls connecting said base end to said top end, said sidewalls being concave toward an interior of said container;

a reinforcing pattern formed in said sidewalls for further precluding distortion of said sidewalls;

a conduit extending along said sidewalls outboard of said container from the top end to the base end, said conduit joining said second opening at said top end of said container, said conduit being in liquid communication with the inside of said container at the base end thereof; and valve actuator means within said second opening for use in operating a valve in a coupling connectable to said second opening;

wherein said top end has a first characteristic shape and said base end has a second characteristic shape such that said base end of one container is nestable within the top end of another container for vertical stacking and storage of a plurality of containers, said second characteristic shape including opposing base sections alternated with opposing recessed areas, and a channel connecting the opposing base sections to facilitate complete drainage of concentrate from the container when the container is in an upright orientation, and wherein said concave sidewalls are outwardly expandable.

8. The system of claim 7, wherein said top end has a handle thereon, said handle having first and second gripping portions spaced apart for receiving the channel of the base end therebetween in a direction perpendicular to the gripping portions of said handle, said channel resting flat on said planar stacking surface.

9. The system according to claim 7, wherein said reinforcing pattern includes a hub portion having a center point at a distance from about one-half to about two-thirds of the distance down from the planar stacking surface of the container and a plurality of recessed ribs radially extending from the hub.

10. The system of claim 7, wherein said reinforcing pattern includes a hub portion having a concentric center at a position two-thirds of the distance down from the planar stacking surface of the container and a plurality of recessed ribs radially extending from the hub.

11. The system of claim 7, wherein said vent means includes a frangible foil secured over said first opening.

12. The system of claim 7, wherein said first opening is formed in an upstanding cylindrical neck portion of said top end, said neck portion having a threaded external finish.

13. A disposable container for storing liquid concentrate comprising:

a top end including a first opening through which said container may be filled, a second opening through which concentrate may be withdrawn, a bifurcated handle member having a first handle portion adjacent the first opening, a second handle member adjacent the second opening, an interlock area formed between the first and second handle members and a planar stacking surface;

a base end for supporting said container in an upright position, said base end including opposing base sections alternated with opposing recessed areas and a channel connecting the opposing base sections to facilitate complete drainage of concentrate between base sections when the container is in an upright orientation;

sidewalls connecting said base end to said top end, said sidewalls being concave toward an interior of said container;

a reinforcing pattern formed in said sidewalls for further precluding distortion of said sidewalls; and a conduit extending along said sidewalls outboard of said container, from the top end in communication with said second opening to the base end in liquid communication with the inside of the container.

14. The container according to claim 13, wherein said channel fits within said interlock area when a container is stacked on a like container at a 90° orientation with respect thereto.

15. The system according to claim 13, wherein said reinforcing pattern includes a hub portion having a center point at a distance from about one-half to about two-thirds of the distance down from the planar stacking surface of the container and a plurality of recessed ribs radially extending from the hub.

16. The container according to claim 13, wherein said reinforcing pattern includes a hub portion having a center which is positioned a distance two-thirds down from the planar stacking surface of the container and a plurality of recessed ribs extending radially from the hub.

* * * * *